United States Patent [19]

More

[11] Patent Number: 4,905,692

[45] Date of Patent: Mar. 6, 1990

[54] MEDICAL AND ORTHOPEDIC SUPPORT FABRIC

[75] Inventor: Marcos A. More, Knoxville, Tenn.

[73] Assignee: K. T. Medical, Inc., Knoxville, Tenn.

[21] Appl. No.: 117,758

[22] Filed: Nov. 5, 1987

Related U.S. Application Data

[63] Continuation-in-part of Ser. No. 846,467, Mar. 28, 1986, which is a continuation of Ser. No. 569,582, Jan. 10, 1984, abandoned.

[51] Int. Cl.[4] ..... A61B 17/32

[52] U.S. Cl. ..... 606/151; 128/849; 606/167

[58] Field of Search ..... 128/305, 334, 335, 849

[56] References Cited

U.S. PATENT DOCUMENTS

| | | | |
|---|---|---|---|
| 2,009,361 | 7/1933 | Lawson | 66/109 |
| 2,319,340 | 5/1943 | Nebel | 66/200 X |
| 2,536,163 | 1/1952 | Field et al. | 66/202 |
| 2,720,097 | 10/1953 | Mond | 66/202 |
| 2,811,154 | 10/1937 | Scholl | 128/156 |
| 3,040,551 | 6/1962 | Urlaub | 66/170 |
| 3,060,932 | 10/1962 | Pereny et al. | 128/849 |
| 3,069,885 | 12/1962 | Cooper et al. | 66/195 |
| 3,250,095 | 5/1966 | Bird | 66/202 |
| 3,570,482 | 3/1971 | Emoto | 128/156 |
| 3,828,585 | 8/1974 | Thorneburg | 66/136 |
| 4,222,383 | 9/1980 | Schossow | 128/335 |
| 4,322,232 | 3/1982 | Beane | 66/136 |
| 4,531,521 | 7/1985 | Haverstock | 128/335 |

OTHER PUBLICATIONS

Reichman, Advanced Knitting Principles Chapter 7, pp. 36–41, Dec. 1967.

*Primary Examiner*—Dalton L. Truluck
*Attorney, Agent, or Firm*—Bailey & Hardaway

[57] ABSTRACT

A fabric for medical and orthopedic applications which may be cut by severence to desired shapes without significant raveling.

4 Claims, 3 Drawing Sheets

MEDICAL AND ORTHOPEDIC SUPPORT FABRIC

This is a continuation-in-part of More, Ser. No. 06/846,467, filed Mar, 28, 1986, now abandoned which is a continuation of More, Ser. No. 569,582, filed Jan. 10, 1984, which is now abandoned.

BACKGROUND OF THE INVENTION

This invention relates generally to the art of knit fabrics and more particularly to a knit fabric with medical applications.

Various fabrics have been utilized for orthopedic applications. A bandage fabric described in the U.S. Pat. No. 3,570,482 to Emoto. Such a bandage is comprised of chain stitches formed of non-elastic yarn running in one direction and elastic polyurethane running into another. Another popular surgical bandage and orthopedic support is sold under the trademark "Ace Bandage". Such a fabric is generally elastic in the length direction so as to provide a bandage which may be applied under tension so as to provide a constant force to the area of the body to which it is wrapped.

Prior art knit fabrics are disclosed in U.S. Pat. Nos. 3,069,885 and 2,127,139 which are herewith incorporated by reference.

While other prior art bandages exist, all are subject to problems associated with raveling in the event that the fabric itself is severed.

SUMMARY OF THE INVENTION

It is thus an object of this invention to provide a fabric for surgical and orthopedic applications which may be cut by severence to desired shapes without significant raveling.

It is a further object of this invention to provide a fabric which is elastically deformable in both the length and width directions.

It is a further and more particular object of this invention to provide such a fabric which is subject to many and diverse orthopedic and surgical applications.

These as well as other objects are accomplished by a fabric for medical and orthopedic support comprising a plaited ribbed knit fabric plaited with spandex yarn to provide a fabric which stretches in both length and width directions.

DETAILED DESCRIPTION

In accordance with this invention it has been found that a ribbed plaited knit fabric having spandex as the plaited yarn possesses elastic deformation in both the length and width directions thereof and the ability to be precisely severed without significant raveling. Further and other advantages will become apparent from a reading of the following description given with reference to the various figures of drawing.

Figure 1:
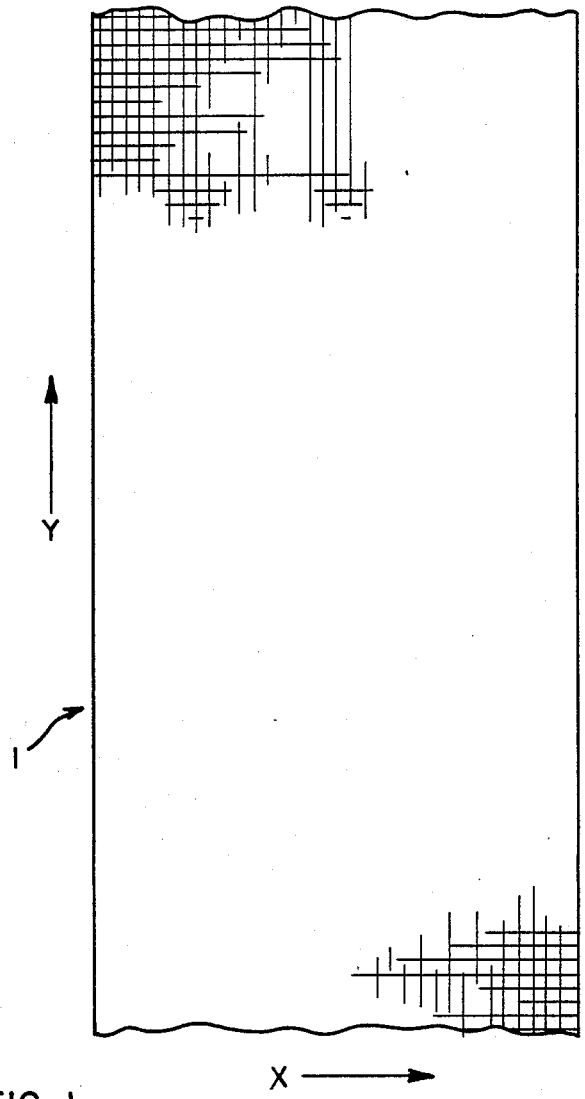
FIG. 1 of the drawings illustrates a knit fabric in accordance with this invention.

FIG. 1 of the drawings illustrates the fabric 1 in accordance with this invention. As illustrated in FIG. 1 the fabric extends along its length in the Y direction and across its width in the X direction. As generally utilized in knitting terminology the Y direction is generally referred to as the warp direction while the X direction is referred to as the weft direction. The fabric which is intended for medical and orthopedic support situations is elastically deformable in both the length and width directions and preferably may be extended from about 50 to 120% in both directions. The fabric may be produced to have a modulus of elasticity within desired ranges by selection of appropriate spandex and tensioning. The fabric is plaited with spandex such that the spandex only exists within the central area of the fabric with the plaiting yarns coming in contact with the skin of a patient on which it is utilized.

The fabric in accordance with this invention has utilization wherein limbs may be wrapped so as to provide support in the two directions of elongation and may be severed to fit a particular area of the body. Additionally, the fabric may be knitted in tubular form so as to form a surgical weight hose.

The fabric may be utilized for wrapping of limbs after surgery to prevent pooling of blood. Additionally, stocking or wrappings of the fabric in accordance with this invention may be utilized under tubular orthopedic plaster of paris casts. Previously, two sizes of stocking were required under plaster of paris casts in order to conform to the shape of a limb. However, with the dual stretch characteristics, the fabric of this invention may be utilized to conform to a tapering limb.

The medical utilization of the fabric of this invention includes the coverage of burned skin to both support and isolate the burned area from the surrounding environment.

Due to the characteristics of this fabric whereby it does not ravel upon severence it may be utilized about portions of the body where surgery is to be performed with incision made through the fabric and into the patient. Under such circumstances the elasticity of the fabric maintains the configuration of the body portion, while also preventing excessive swelling. The use of such fabric during orthoscopic surgery of the knee is an example.

Additionally, the fabric of this invention may be utilized to isolate portions of the body during surgery due to its ability to conform to limbs. An example is the isolation of the foot area during surgery to the leg. Also, the fabric of this invention may be combined with a water impermeable lining material to aid in the isolation of such body portions.

The fabric of this invention is particularly adaptable for utilization where significant movement is required, such as bandages about the knee, ankle and elbow. The two direction stretch properties permit such utilization for orthopedic support while also allowing movement.

Figure 2:
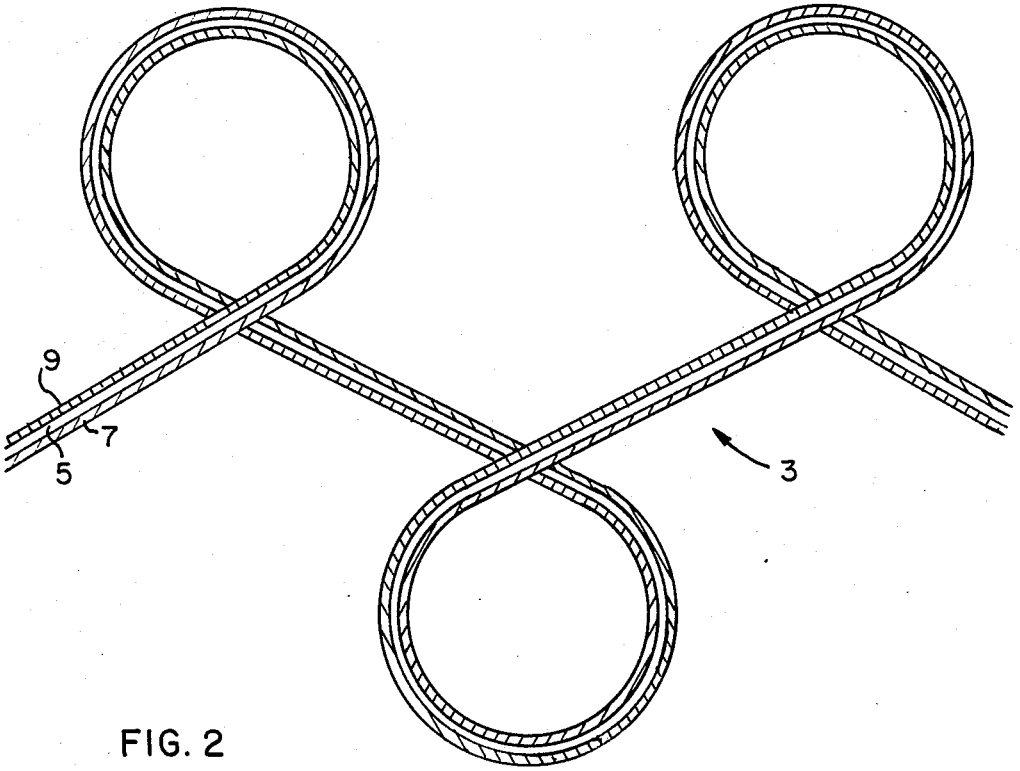
FIG. 2 of the drawings illustrates the plaited knit in accordance with this invention.
Figure 3:
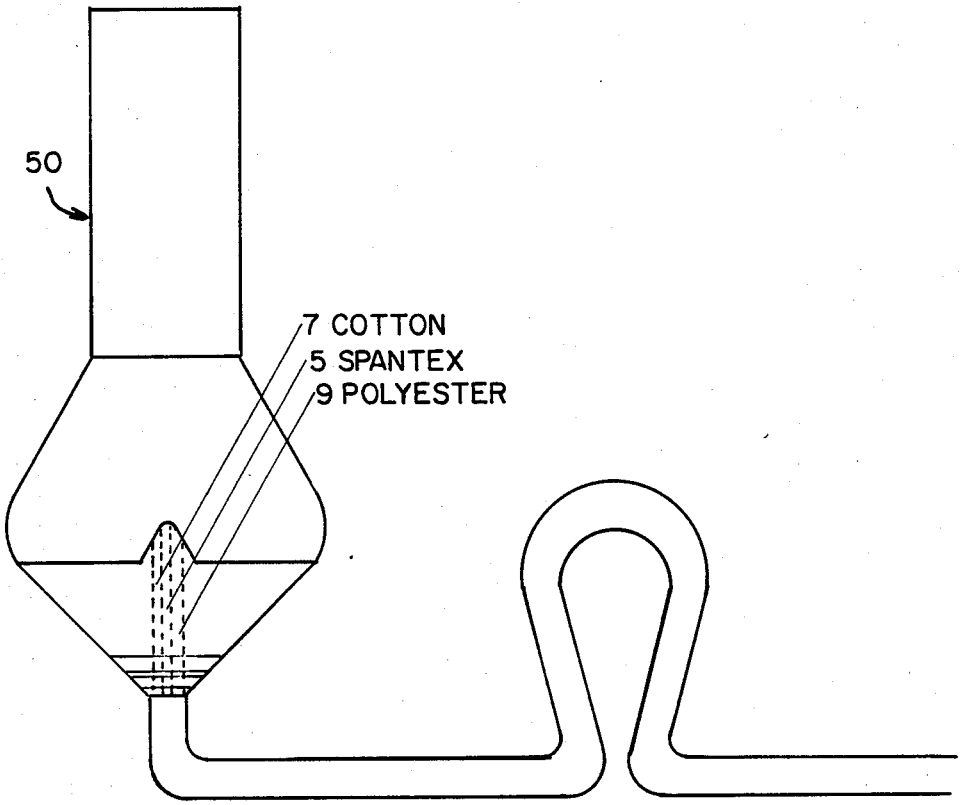
FIG. 3 of the drawings illustrates a yarn feeder for producing the fabric of this invention.

FIG. 2 of the drawings illustrates the knit of the fabric of this invention, wherein the knitted pattern 3 is plaited with one yarn 5 being a polyurethane, preferably spandex and with the yarn 7 being a synthetic fiber, preferably polypropylene. A knit yarn feeder 50 is illustrated in FIG. 3 for producing this result.

The term "spandex" as utilized within this specification is utilized in its common generic context, meaning an elastomeric polyurethane which may be any of the fabrics sold under the trademark LYCRA. Generally, spandex may be of 120 to about 800 denier. The knit fabric is ribbed preferably of a $1 \times 1$ rib. It is preferred to utilize a single stitch rib due to enhanced elasticity of such a fabric.

The preferred knitting yarn is continuous filament polypropylene. Preferably the polypropylene is a single ply comprising from about 20 to 40 filaments. The polypropylene may be from about 100 to 200 denier depending on the particular desired applications.

The elastic characteristics in the width direction imparted to this fabric is due in part to the single-stitch rib construction as well as to the spandex plaited yarn. The spandex, however, is entirely responsible for the stretch and elongation characteristics in the length direction.

To a large extent, the ability of the fabric to be severed without raveling is attributable to the presence of spandex. The fabric, if knitted without spandex, ravels to some extent, but surprising when spandex is utilized the fabric itself does not ravel. This is a surprising and unexpected advantage of this invention.

As many terms are utilized within this description which are particular to the knitting art, such terms have the common meanings thereof as are described in *DUBIED KNITTING MANUAL,* Edward Dubied and Cie Sa, Neuchatel, Switzerland, Copyright 1967, which is herewith incorporated by reference.

As many variations will become apparent from a reading of the above description such variations are included within the spirit and scope of this invention as defined by the following appended claims.

What is claimed:

1. A process for performing surgery comprising the steps of:

wrapping a body portion with a fabric to support said body portion, said fabric plaited with an elastomer to provide a fabric with elastic properties in both the length and width directions thereof, and wherein said fabric includes a knitted non-elastic synthetic fiber, said fiber having the ability to be severed while maintaining the stability of the knit structure;

surgically incising said body portion through said ravel-free fabric whose elastic properties in both length and width directions help maintain the configuration of the body.

2. The process described in claim 1 wherein said elastomer is polyurethane.

3. The process described in claim 2 wherein said polyurethane is spandex.

4. The process described in claim 1 wherein said non-elastomeric synthetic fiber is selected from the group consisting of polyesters, polyalkenes and polyamides and, more specifically wherein said polyalkene is polypropylene and said polyamide is nylon.

* * * * *